US007150111B2

(12) United States Patent
Viljanmaa

(10) Patent No.: US 7,150,111 B2
(45) Date of Patent: Dec. 19, 2006

(54) METHOD AND EQUIPMENT FOR PRODUCING DRIVING POWER IN A PAPER OR BOARD MILL

(75) Inventor: Mika Viljanmaa, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 76 days.

(21) Appl. No.: 10/508,103

(22) PCT Filed: Mar. 17, 2003

(86) PCT No.: PCT/FI03/00199

§ 371 (c)(1),
(2), (4) Date: Sep. 15, 2004

(87) PCT Pub. No.: WO03/078728

PCT Pub. Date: Sep. 25, 2003

(65) Prior Publication Data

US 2005/0160618 A1 Jul. 28, 2005

(30) Foreign Application Priority Data

Mar. 19, 2002 (FI) ..... 20020519

(51) Int. Cl.
*F26B 3/00* (2006.01)

(52) U.S. Cl. ..... 34/446; 34/117

(58) Field of Classification Search ..... 34/446, 34/117; 162/358.1

See application file for complete search history.

(56) References Cited

U.S. PATENT DOCUMENTS

| | | | | |
|---|---|---|---|---|
| 3,668,785 A | | 6/1972 | Rodwin | |
| 3,874,091 A | * | 4/1975 | Fukumoto | 34/66 |
| 3,919,783 A | * | 11/1975 | Cirrito | 34/450 |
| 4,146,361 A | | 3/1979 | Cirrito | |
| 5,306,395 A | | 4/1994 | Myren | |
| 6,101,735 A | | 8/2000 | Kuhasalo et al. | |
| 6,294,050 B1 | * | 9/2001 | Oechsle et al. | 162/207 |
| 6,428,655 B1 | | 8/2002 | Kerttula | |

FOREIGN PATENT DOCUMENTS

| | | |
|---|---|---|
| FI | 78137 | 6/1989 |
| FI | 104100 B | 11/1999 |
| FI | 20002628 | 11/2000 |
| FI | 20012142 | 11/2001 |
| GB | 1264992 | 2/1972 |
| SU | 825751 | 4/1981 |
| WO | WO 98/27391 A1 | 6/1998 |
| WO | WO 9932714 A1 | 7/1999 |
| WO | WO 02/44469 A1 | 6/2002 |
| WO | WO 03/042520 A1 | 5/2003 |
| WO | WO 03/078728 A2 | 9/2003 |
| WO | WO 03/078728 A3 | 9/2003 |

OTHER PUBLICATIONS

Search Report issued in Finnish Patent Application No. 20020519 dated Feb. 2004.
International Preliminary Examination Report issued in PCT/FI03/00199 dated Sep. 2004.
Notification of the First Office Action issued in CN 038063271.1

* cited by examiner

*Primary Examiner*—S. Gravini
(74) *Attorney, Agent, or Firm*—Stiennon & Stiennon

(57) ABSTRACT

A paper or board mill includes a drying section, which includes at least one drying cylinder group and at least one impingement drying unit (PK). The method uses a turbine engine (10), the combustion gases (1) of which are conducted at least into the impingement drying unit (PK) as impingement air.

14 Claims, 3 Drawing Sheets

METHOD AND EQUIPMENT FOR PRODUCING DRIVING POWER IN A PAPER OR BOARD MILL

CROSS REFERENCES TO RELATED APPLICATIONS

This application is a U.S. national stage application of International App. No. PCT/FI03/00199, filed Mar. 17, 2003, and claims priority on Finnish Application No. 20020519, Filed Mar. 19, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The subject matter of the invention is a method for producing driving power in a paper or board mill, and equipment for producing driving power in a paper or board mill.

In this application, production of driving power means production of at least heat, steam, negative pressure, positive pressure, blow and electricity.

In a paper or board mill, heat energy, negative pressure, compressed air, blowing and electric energy are used in several places. The heat energy used may be in the form of e.g. hot air blast or in the form of steam.

Much heat energy and negative pressure is used in the paper or board mill's drying section in particular, and in state-of-the-art paper or board mills the drying section forms a bottleneck. With increasing paper or board machine speeds the drying section must be made longer in order to achieve a sufficient drying power. In addition, at high speeds various runnability components must be used, such as suction boxes and vacuum rolls, that is, so-called VAC rolls, in order to improve runnability. Such runnability components of different kinds are used both in the drying section and also e.g. in the formation section and in the press section.

In the drying section of state-of-the-art paper or board mills the paper or board is traditionally dried by drying cylinders using steam as their heat source. The steam required is usually produced in a separate steam production plant located in connection with the paper or board mill. The plant in question may be one producing only steam or one producing both steam and electricity. The paper or board mill's drying section applying cylinder drying is usually constructed so that every second roll is a heated drying cylinder while every second roll is a VAC roll. Hereby the web travels along a zigzag path from the drying cylinder to the VAC roll and from the VAC roll to the drying cylinder.

The negative pressure needed in the paper or board mill is usually produced by several separate vacuum pumps. These vacuum pumps are of large physical size and the driving motor of each vacuum pump is a high-powered, and thus also big, electric motor. The coefficient of efficiency of such vacuum pumps is very low, whereby it is very expensive to produce the negative pressure.

In a paper or board mill compressed air is used e.g. in the web transfers and in threading and also in various pieces of compressed air equipment. Compressed air is also used for producing negative pressure, e.g. in various blow-suction boxes. Negative pressure is produced in such places where it is possible using compressed air, because production of negative pressure by vacuum pumps is very expensive. The compressed air is produced by separate compressors, the driving motor of which may be an electric motor.

In the latest drying section solutions of state-of-the-art paper or board mills, drying is boosted by so-called impingement drying units. Metso Paper, Inc. markets such impingement drying units under its OptiDry trademark. The paper is taken on to the outer surface of the shell of the VAC roll having a relatively large diameter, where it will move through nearly a full revolution. In addition, in connection with the outer surface of the VAC roll at least one impingement unit is fitted, which is used to blow air at an approximate temperature of 350° C. against the web surface at an approximate speed of 90 m/s. The impingement unit includes a burner, a blowing fan and a lot of electric technology. The combustion gases of the impingement unit's burner are blown by a blowing fan towards the web surface. Some advantageous fuel such as natural gas may be used as the energy source for the impingement unit's burner. A vacuum pump is used to produce the negative pressure for the VAC roll of the impingement drying unit.

The following is a presentation of some state-of-the-art publications, which present paper or board mills applying impingement. By these references the concerned publications are included in the present application.

Metso Paper, Inc.'s FI patent 104100 presents an integrated paper machine using impingement in the drying of paper. The publication presents a pre-drying section, which is formed by a suction cylinder having a perforated shell and a diameter of 8–20 m and by a connected impingement device. Reference is also made in the publication to a planar pre-drying section equipped with impingement and to a pre-drying section of the Condebelt type.

Metso Paper, Inc.'s U.S. Pat. No. 6,101,735 presents several different drying sections of a paper machine applying impingement. The publication presents a planar impingement drying section and a drying section, where impingement units are fitted in connection with large-diameter drying cylinders.

Metso Paper, Inc.'s FI patent application 20002628 presents a drying section in a paper or board machine applying impingement. This uses a suction roll having a large diameter, preferably over 10 m, and impingement units fitted in connection with this.

Metso Paper, Inc.'s U.S. Pat. No. 5,306,395 for its part presents a tissue machine using a large-diameter suction roll and impingement. Here the press section of the tissue machine is replaced by a so-called TAD pre-drying section. The TAD pre-drying section is formed by a large-diameter suction roll, and an impingement unit is fitted in connection therewith. The impingement unit is used to blow hot air through the web traveling on the suction roll surface. From the TAD pre-drying section the web is moved on to the surface of a Yankee cylinder. In connection with the Yankee cylinder an impingement unit is also fitted, which is used to blow hot air against the web.

In state-of-the-art paper or board mills the following are needed in order to bring about the above-mentioned functions:

- a steam production plant together with related systems for producing steam,
- vacuum pumps to produce negative pressure, driving motors for the vacuum pumps, that is, electric motors, control systems and lubrication systems,
- compressors to produce compressed air for peripheral equipment, burners and blowing fans for the impingement units, electric drives for the blowing fans with controls, current sources etc.

State-of-the-art paper or board mills thus need many separate systems in order to produce the above-mentioned functions. Separate systems are expensive, they make the system complicated and they contain a lot of details where failure may occur and which need maintenance. In addition, energy losses occur in all the above-mentioned systems, which results in a poorer total coefficient of efficiency and thus in poorer economy for the system.

SUMMARY OF THE INVENTION

The solution according to the invention is suitable for use in all the above-mentioned state-of-the-art paper or board mills.

With the solution according to the invention all the systems listed above, which are used in state-of-the-art solutions, are replaced by a turbine engine. The jet turbine is able to produce all the above-mentioned functions with a coefficient of efficiency considerably superior to the systems of today. In addition, almost all losses occurring in the system are internal, that is, all the energy derived from the fuel will end up as either heat energy or motion energy to benefit the process.

Table 1 shows a comparison between the production values of an OptiDry impingement unit provided by Metso Paper, Inc. and those of a turbine engine of the by-pass type of the General Electric company known under the model code CF6-80C2. This turbine engine is in general use, e.g. in MD 11 aircraft. However, the invention is not limited in any way only to a turbine engine of the by-pass type, but the turbine engine may be of any type. A turbine engine of the by-pass type may be suitable for some applications, whereas a turbine engine with no by-pass flow may be suitable for other applications. In some situations it may also be advantageous to use post-combustion.

TABLE 1

| Performance values | Metso Paper, Inc.'s OptiDry | CF6-80C2 (in test run conditions) |
|---|---|---|
| Temperature (° C.) | 350 | 550–600 |
| Flow rate (m/s) | 90 | 250 |
| Volume flow ($m^3$/s) | 30 | 115 |

Table 1 shows that the volume flow of the combustion gases of one CF6-80C2 turbine engine is approximately four times the volume flow of the OptiDry impingement unit. Nor does the turbine engine need any separate blowing fan to produce this volume flow. In addition, the temperature of the CF6-80C2 turbine engine is higher by 200–250° C. than the temperature of the OptiDry unit. By a rough estimate, the increase in drying efficiency due to the higher temperature could be approximately 35%. Test runs performed by the applicant with the OptiDry impingement unit indicate that in a temperature range of 150–350° C. the drying efficiency is essentially linearly dependent on the temperature of the impingement unit's impingement air. It is probable that this linear dependency does not continue directly all the way to the turbine engine's temperatures of 550–600° C., and for this reason the assumption is used in the estimate that the increase in drying efficiency could be approximately one-half of the increase in temperature.

Based on the above it can be assumed that at a rough estimate the above-mentioned CF6-80C2 turbine engine produces as much drying power as approximately 9 OptiDry impingement units.

The negative pressure needed by the VAC rolls and by the other runnability components is obtained from the suction side of the turbine engine. In aircraft use, the objective is to optimize the air intake rings of engines in such a way that the resulting suction (negative pressure) would be as low as possible. The air ring has a coefficient of efficiency of about 0.95, that is, a normal air pressure of 0.95 * exists at the air intake ring. When the normal pressure is 101.3 kPa, a negative pressure of approximately 5 kPa exists at the suction ring. In the VAC rolls, there is a typical negative pressure of 2 kPa, so with the turbine engine's volume flow it is possible adequately to produce all the negative pressure needed in the paper or board mill. Production of the negative pressure will not result in any reduced total coefficient of efficiency in the entire process, because throttling of the turbine engine's flow will for its part increase the turbine's outlet temperature.

The turbine engine is used in aircraft to produce thrust and also to produce compressed air. The required compressed air is hereby drained from the supercharger of the engine. Pressure ratios (pressure at the supercharger/atmospheric pressure) are fairly high in engines of today, typically 20–30, that is, these are multiple ratios compared with the compressed air network of a normal paper or board mill. Since the turbine engine's air volume is very high, the turbine engine's pressure ratio will hardly change at all, even though the compressed air volume needed by the paper or board mill is drained from the supercharger.

The hot air returning from the impingement unit can be taken to a steam generator (or to a boiler), whereby heat energy can be stored in steam, which for its part is used to heat the drying cylinders of the drying section in the paper or board mill. In the OptiDry impingement unit the temperature of returning air is typically lower by approximately 100° C. than the temperature of the air blown into the unit, that is, approximately 250° C., which is sufficient for producing steam. When using a higher temperature for the air blown into the unit, the temperature of the returning air is also higher and the generation of steam is more efficient. Heat may also be recovered from the condensate returning from the drying cylinders, e.g. by using a heat pump.

It is known as such at turbine power plants to produce steam with the aid of a turbine engine's combustion gases. The turbine engine rotates a generator, which is used for producing electricity. The turbine engine's combustion gases are used for generating steam, which for its part is used to rotate a steam turbine. The steam turbine again rotates a generator, which is used to produce electricity. The cooled steam returning from the steam turbine is used further for producing district heating. A coefficient of efficiency of over 90% can be reached at such power plants, at an estimate.

Thus, the turbine engine can also be used as the generator's power source, whereby the electricity needed by the paper or board mill can be produced in the manner known at turbine power plants.

Several advantages can be reached compared with state-of-the-art solutions by using the solution according to the invention.

Due to the high drying efficiency of the solution according to the invention, the drying section of the paper or board mill can be shortened significantly, by 30–50% at an estimate, compared with a drying section equipped with state-of-the-art impingement units. Owing to the shortened drying section, the paper or board mill needs a smaller building.

The system according to the invention is simple. One piece of equipment, that is, a turbine engine may be used for producing heat for producing heating and steam, blowing, negative pressure, compressed air and also electric energy when required.

The system according to the invention is highly efficient. With one turbine engine it is possible to produce blowing, e.g. into the impingement hoods, which are mounted above all VAC rolls in the drying section.

The system according to the invention has a high coefficient of efficiency. Nearly all losses are inside the system, that is, almost all energy released from the fuel will end up benefitting the process. The coefficient of efficiency of the turbine engine is high, and it burns the fuel at higher temperatures than the state-of-the-art impingement units. The total coefficient of efficiency of the system may be improved further by utilizing the re-circulated air of the impingement unit for generation of steam and this way e.g. for heating the drying cylinders.

The system according to the invention is quickly adjustable. Quick adjustability allows prompt grade changes as well as speedy start-ups and shutdowns.

The adjustability of the system according to the invention is simple. In a turbine engine of the by-pass type the temperature and the blowing power can be adjusted independently of each other by controlling the by-pass flow and/or the fuel supply.

The system according to the invention needs less space than state-of-the-art solutions. At a rough estimate, the turbine engine's need of space is equal to that of one state-of-the-art vacuum pump producing negative pressure for VAC rolls. The ratio between efficiency and weight of the turbine engine is better than in any known solutions. The investment costs of the paper or board mill are reduced owing to the reduced need of hall space and also owing to savings from eliminated systems.

In the system according to the invention it is possible to use several gaseous and liquid fuels, because the turbine engine is not restricted to any one fuel.

The system according to the invention is very suitable for modernizing old paper or board mills. The turbine engine may be located e.g. in the place of one eliminated vacuum pump and it can easily be connected to the mill's compressed air network and to its negative pressure network. It is also easy to build a network for transferring combustion gases to the impingement drying units and to the steam generation plant.

The turbine engine for use in the system according to the invention is very reliable in operation.

The control and measuring systems of the turbine engine used in the system according to the invention have already been developed. Turbine engine equipment is used widely in aviation and at power plants.

The centralized system according to the invention is more advantageous from the viewpoint of noise abatement. One noise source, that is, the turbine engine, is more easily encapsulated and/or shaded than several noise sources located in different places around the mill.

There is an existing worldwide service organization for the turbine engine used in the system according to the invention.

The solution according to the invention lowers the energy costs of the paper or board mill. The annual energy costs of a state-of-the-art paper machine are divided in accordance with table 2, at a rough estimate:

TABLE 2

| | Electricity | Steam | Gas |
|---|---|---|---|
| Quantity (GWh) | 187 | 157 | 70 |
| Price (€/kWh) | 0.15 | 0.06 | 0.1 |
| Annual costs (M€) | 4.7 | 1.6 | 1.2 |

Of this annual quantity of electric energy of 187 GWh about 33.5% are spent in the electric motors of the paper or board mill's vacuum pumps, 16.7% are spent in the driving motors of the air systems and 5.4% are spent in the driving motors of the drying section.

In the solution according to the invention no vacuum pumps are needed, the air systems are simplified considerably and the drying section is considerably shortened. If the need for driving motors in air systems and in the drying section is reduced by one-half and all vacuum pumps are eliminated, the annual consumption of electric energy will be reduced by approximately 2 million €.

By implementing the drying section mainly with OptiDry units and by applying the solution according to the invention therein savings in investment costs are achieved in comparison with the traditional paper or board equipment applying cylinder drying. The necessary hall building is shorter, the number of drying cylinders and related VAC rolls can be minimized and no separate vacuum equipment is needed. Additional costs result from the acquisition of OptiDry units and the turbine engine.

In the following, a solution according to the invention will be described with reference to the figures in the appended drawings, but the intention is not to limit the invention solely to the details shown therein.

DESCRIPTION OF THE PREFERRED EMBODIMENTS

Figure 1:
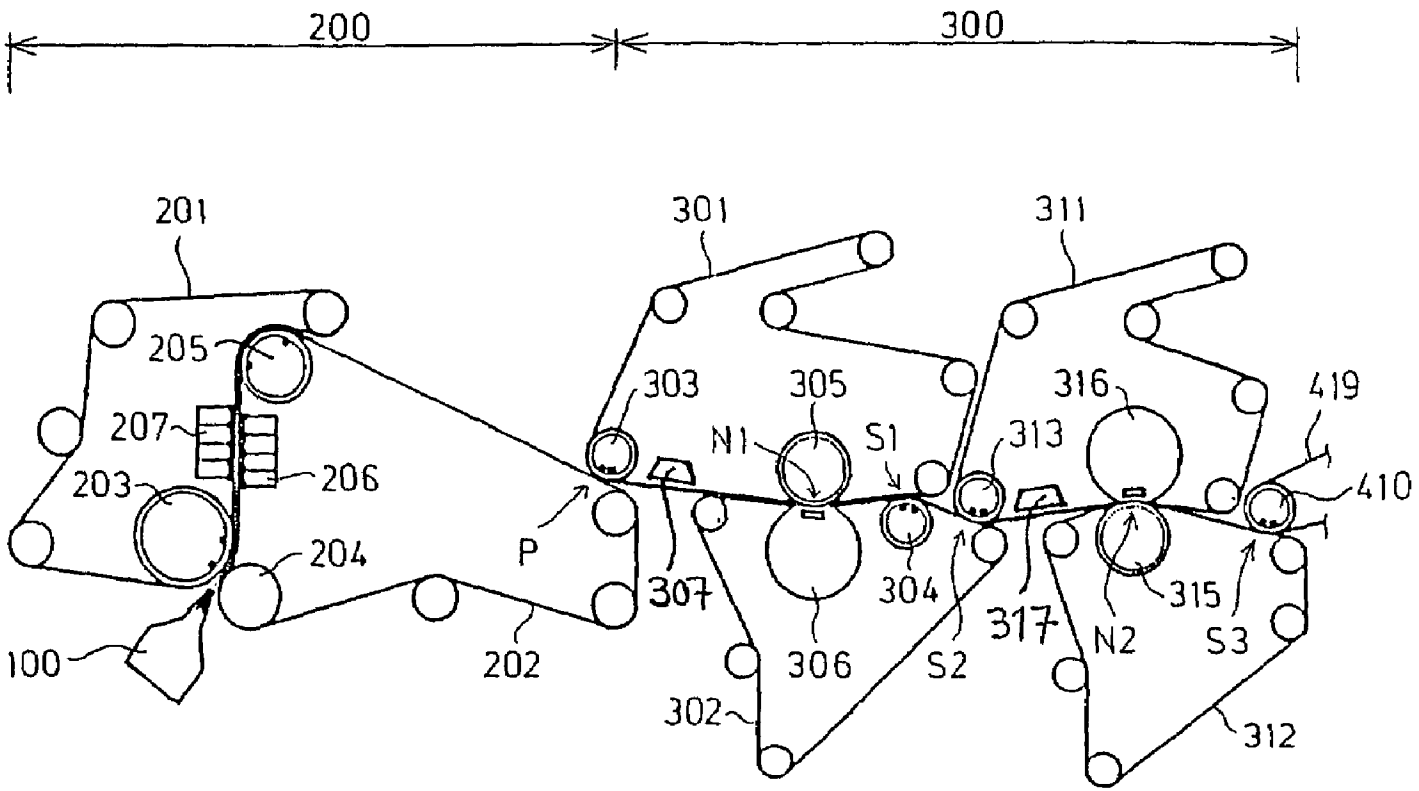
FIG. 1 is a schematic view of the forward end of a paper or board production line.
Figure 2:
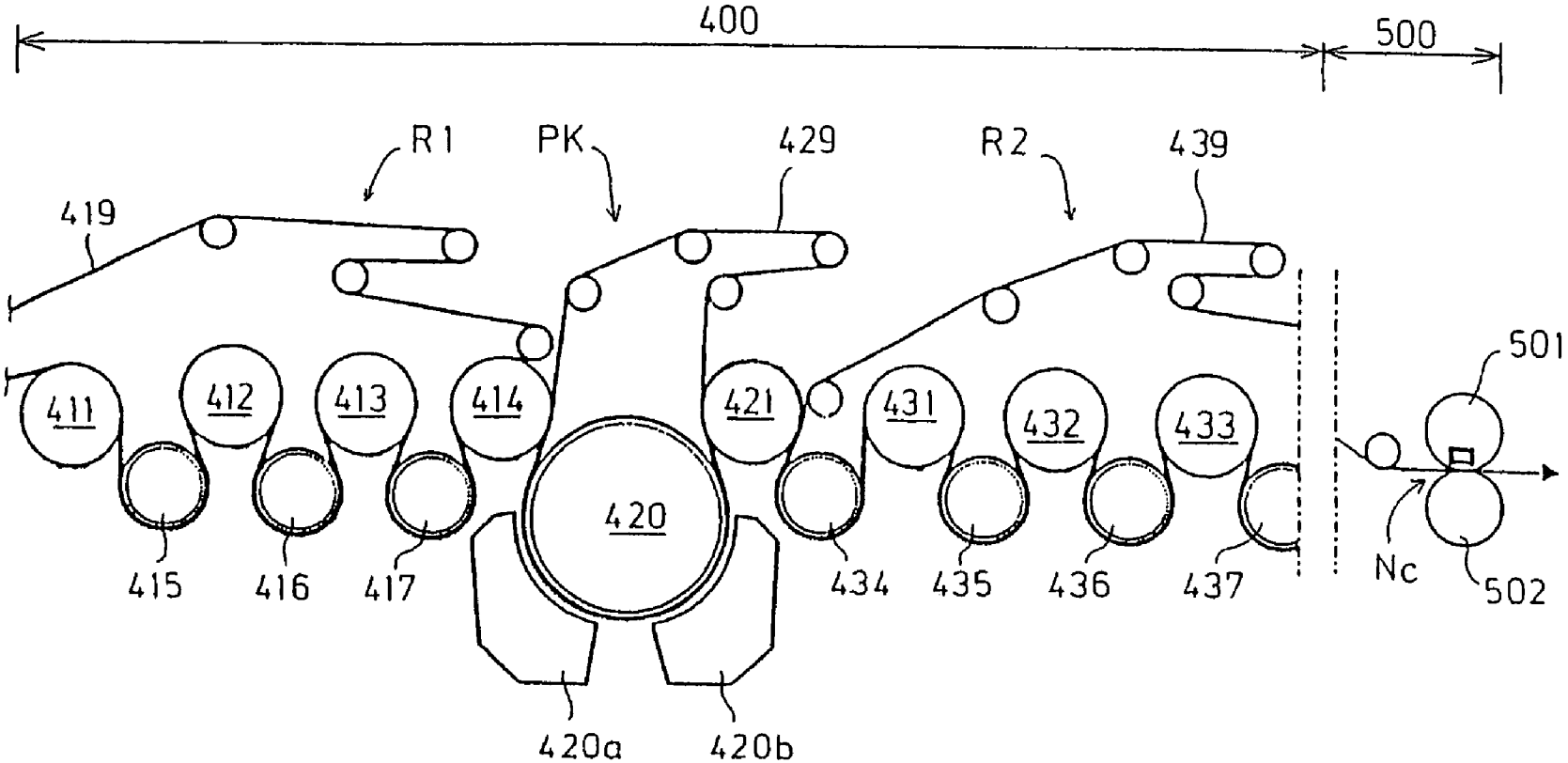
FIG. 2 is a schematic view of the final end of the paper or board production line shown in FIG. 1.

FIGS. 1 and 2 show a paper or board production line, where the solution according to the invention can be applied. The line includes in the web direction of travel a headbox 100, a jaw former 200, a press section 300, a drying section 400 and a final calender 500.

FIG. 1 shows the forward end of the line, that is, the headbox 100, the jaw former 200 and the press section 300. Headbox 100 may be any kind of headbox suitable for the jaw former. In the jaw former 200 there are a first wire loop 201 and a second wire loop 202, between which an essentially vertical formation zone is formed. From the headbox 100 the pulp is fed into a jaw formed by the first 201 and the second 202 wire loop in between the former roll 203 forming the first dewatering unit and the breast roll 204. In the formation zone a second dewatering unit 207 is arranged inside the first wire loop 201 and a third dewatering unit 206 is arranged inside the second wire loop 202. The dewatering units 203, 206, 207 are used for removing water from the web and for improving the formation of the web to be formed. At the end of the formation zone the traveling direction of the formed web is reversed with the aid of the vacuum of a suction roll 205 located inside the second wire loop 202, which suction is used to detach the web from the first wire 201 and to attach it to the second wire 202, in the support of which the web is transferred to pick-up point P, where the web is detached from the second wire 202 by pick-up suction roll 303 and it is transferred in the support of the first press felt 301, that is, the pick-up felt, to press section 300.

After pick-up point P the web is kept attached to the bottom surface of the first press felt 301 by the internal suction box 307 of the press section's 300 first press felt link and it is taken between the first top press felt 301 and the second bottom press felt 302, where the web travels into a first press nip N1. The first press nip N1 is a long nip, which is formed by a lower shoe roll 306 equipped with a loading shoe and felt shell and by an upper backing roll 305 provided with a cored-out surface. After the first press nip N1 the web is detached from the first press felt 301 at a first transfer point S1 with the aid of the negative pressure of a first transfer suction roll 304 located inside the second press felt link and it is attached to the second press felt 302. Then the web is transferred in the support of the second press felt 302 to a second transfer point S2, where the web is detached from the second press felt 302 with the aid of the negative pressure of a second transfer suction roll 313 located inside a third press felt link and it is attached to the third press felt 311.

After the second transfer point S2 of the press section 300 the web is kept attached to the bottom surface of the third press felt 311 with the aid of an internal suction box 317 of the third press felt link and it is transferred into a second press nip N2. The web travels in the second press nip N2 in between the third upper press felt 311 and the lower transfer felt 312. The second press nip N2 is a long nip, which is formed by an upper shoe roll 316 equipped with a loading shoe and a felt shell and by a lower backing roll 315 provided with a cored-out surface. After the second press nip N2 the web is detached from the third press felt 311 and it is transferred in the support of the transfer felt 312 to a third transfer point S3, where the web is detached from the transfer felt 312 with the aid of the negative pressure of a fourth transfer suction roll 410 located inside the drying wire link 419 of the drying section's 400 first drying cylinder group R1. Then the web is transferred in the support of the mentioned drying wire 419 into the drying section 400.

FIG. 2 shows the final end of the line shown in FIG. 1, that is, the drying section 400 and the final calender 500. Only the forward end is shown of drying section 400, where the first drying cylinder group R1 applying single-wire draw is shown, as well as the following impingement drying unit PK and the following second drying cylinder group R2 applying single-wire draw. The first drying cylinder group R1 is a drying cylinder group R1, which is open downwards and wherein the heated drying cylinders 411, 412, 413, 414 are at the top while the suction hitch rolls 415, 416, 417 are at the bottom.

The web is brought into the drying section 400 supported by the drying wire 419 of the first drying cylinder group R1. Then the web travels along a zigzag path in between the drying cylinders 411, 412, 413, 414 and the suction hitch rolls 415, 416, 417 of the first drying cylinder group R1.

From the last drying cylinder 414 of the first drying cylinder group R1 the web moves on at the contact point between the said drying cylinder 414 and the drying wire 429 of impingement drying unit PK on to drying wire 429 of impingement drying unit PK, in the support of which the web moves on to a suction cylinder 420, which has a large diameter, preferably in a diameter range of 3 to 6 m, and which is located under the floor plane of the paper machine hall. The web is kept attached to the outer surface of the drying wire 429 moving around suction cylinder 420 with the aid of the negative pressure of suction cylinder 420. At the suction cylinder 420 the web, which is moving on the outer surface of the drying wire 429 of the impingement drying unit, is subjected to impingement by impingement units 420*a* and 420*b*, which are fitted in connection with suction cylinder 420.

From suction cylinder 420 the web returns in the support of the drying wire 429 of the impingement drying unit moving above the floor level of the paper machine hall and it moves on at the contact point between the drying wire 429 of the impingement drying unit and drying cylinder 421 on to the surface of the said drying cylinder 421. From the surface of the said drying cylinder 421 the web moves on to the contact area between the drying wire 439 of the second drying cylinder group R2 and the said drying cylinder 421, where the web moves on to the drying wire 439 of the second drying cylinder group R2 and further to the first suction hitch roll 434 of the second drying cylinder group R2. Then the web moves along a zigzag path in between the drying cylinders 431, 432, 433 located in the upper row of the second drying cylinder group R2 and the suction hitch rolls 434, 435, 436, 437 located in the lower row.

The second drying cylinder group R2 may be followed by a suitable number of drying cylinder groups applying single-wire draw, between which there may be impingement drying units PK.

From the last drying cylinder group of the drying section the web is transferred to the final calender 500, where the web is calendered. The calender may include one or more calendaring nips Nc and the calendering nips may be roll nips or long nips. Here the final calender 500 is a long-nip calender, which is formed by an upper shoe roll 501 and a lower thermal roll 502. From final calender 500 the web is taken to a reeler (not shown in the figures), where the web is made into machine reels.

Figure 3:
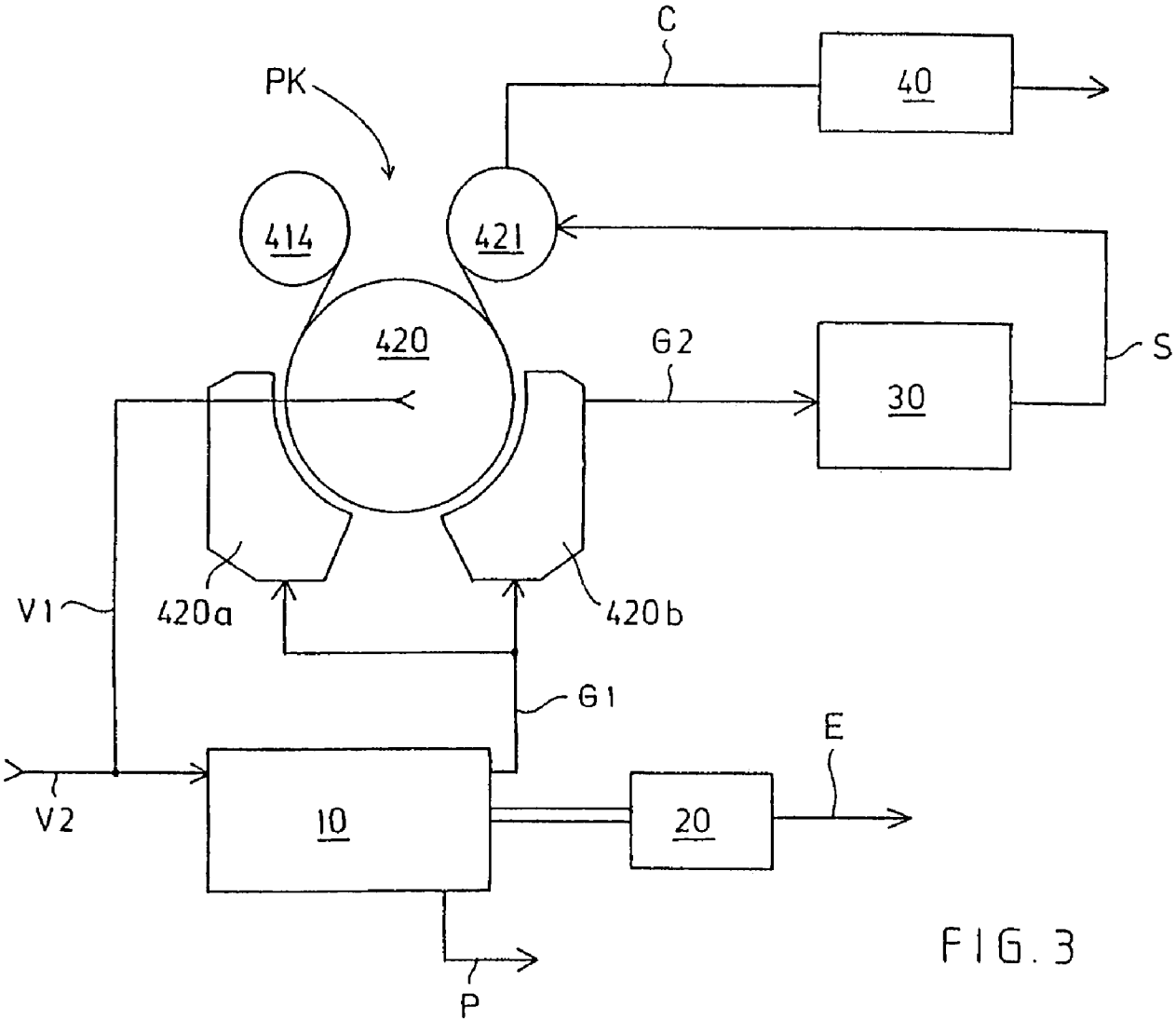
FIG. 3 is a schematic view of the solution according to the invention applied to the paper or board production line shown in FIGS. 1 and 2.

FIG. 3 shows a solution according to the invention as applied to the paper or board production line shown in FIGS. 1 and 2. Of the paper or board production line FIG. 3 shows only the suction cylinder 420 of the impingement drying unit PK, the relating impingement units 420*a*, 420*b* as well as the directly connected drying cylinders 414, 421.

A turbine engine 10 rotates a generator 20, which produces electricity E for the paper or board mill's mains supply and/or for a public mains supply. The turbine's 10 combustion gases G1 are conducted into impingement units 420*a*, 420*b* of the on-blowing impingement drying unit PK in the paper or board mill's drying section 400. The impingement units 420*a*, 420*b* function only as components for conducting combustion gases in this solution, that is, they are used to guide the combustion gases towards the web moving on the outer surface of the shell of VAC roll 420.

The combustion gases G2 returning from impingement units 420*a*, 420*b* are conducted into a steam generation plant 30, where their heat energy is utilized for producing steam. The steam S produced in steam generation plant 30 is for its part conducted into the drying cylinders 414, 421 of the drying section, where the steam S will heat the shell of drying cylinders 414, 421.

The condensate C returning from drying cylinders 414, 421 may be conducted further into a heat pump 40, where any heat energy still remaining in the condensate C is recovered. This recovered heat energy may be used e.g. for heating premises in connection with the paper or board mill.

Turbine engine 10 may also be used for producing negative pressure V1 needed by the VAC rolls 415–417, 420, 434–437 of drying section 400 and negative pressure V2 needed by the formation section's 200 suction rolls, 203, 205, the formation section's 200 dewatering components 206, 207, the press section's 300 suction rolls 303, 304, 313, 410 and the press section's vacuum boxes 307, 317. The turbine engine 10 may be used to produce negative pressure needed by all components using negative pressure in the paper or board mill.

In addition, the turbine engine 10 may be used to produce compressed air P needed by those components in the paper or board mill, which use compressed air P.

Naturally, the solution according to the invention need not include all the alternatives shown in FIG. 3, but the solution shown in FIG. 3 may be used to achieve a very high coefficient of efficiency.

The solution according to the invention based on a turbine engine is not limited in any way to the paper or board production line shown in FIGS. 1–2, but the solution according to the invention may be applied in all paper or board production lines.

The following is a presentation of claims defining the inventive idea, within which the details of the invention may differ from the above presentation, which is given by way of example only.

The invention claimed is:

1. A method for producing driving power in a paper or board mill wherein the paper or board mill includes a drying section, which includes at least one drying cylinder group, which is formed by a plurality of drying cylinders and a plurality of suction rolls, and at least one impingement unit positioned to blow impingement drying air on one of said plurality of drying cylinders, the method comprising the steps of:

using a turbine engine having a suction side, to produce combustion gases which are supplied as impingement drying air to the at least one impingement unit; and connecting the suction side of the turbine engine to the plurality of suction rolls to supply negative pressure to said plurality of suction rolls.

2. The method of claim 1, wherein the one of said plurality of drying cylinders is formed by a suction roll.

3. The method of claim 1, wherein the suction side of the turbine engine also supplies negative pressure to components in the paper or board mill other than the plurality of suction rolls.

4. The method of claim 1 wherein said at least one impingement unit produces re-circulated air which is conducted into a steam generation plant, and wherein the steam generation plant is used to produce steam which is supplied to the plurality of drying cylinders.

5. The method of claim 1 wherein the turbine engine has a pressure side which supplies compressed air to a pressure network of the paper or board mill.

6. The method of claim 1, wherein the the turbine engine is connected to a generator, and produces electricity.

7. A paper or board mill comprising:

a drying section, which includes at least one drying cylinder group, which is formed by a plurality of drying cylinders and by a plurality of suction rolls;

at least one impingement unit, the impingement unit positioned to blow impingement drying air on one of said plurality of drying cylinders;

a turbine engine having a suction side, the turbine engine connected to communicate combustion gases to the said at least one impingement unit as impingement drying air; and a suction network connected to at least the plurality of suction rolls of the drying section and connected to the suction side of the turbine engine, whereby negative pressure produced by the turbine engine is conducted to said plurality of suction rolls.

8. The paper or board mill of claim 7, wherein the one of said plurality of drying cylinders, is formed by a suction roll.

9. The paper or board mill of claim 7, wherein a suction network of other components needing negative pressure in the paper or board mill is further connected to the suction side of the turbine engine, whereby negative pressure produced by the turbine engine is conducted to said other components.

10. The paper or board mill of claim 7, further comprising a steam generation plant connected to receive re-circulated air from the said at least one impingement unit; and wherein the steam generation plant is in steam supplying relationship to the plurality of drying cylinders.

11. The paper or board mill of claim 7, further comprising a pressure network connected to a pressure side of the turbine engine, whereby positive pressure produced by the turbine engine is conducted to said pressure network.

12. The paper or board mill of claim 7, further comprising an electric generator, which is connected to the turbine engine.

13. A method of integrating a turbine engine into a paper or board mill comprising the steps of:

operating a turbine engine to release energy from fuel and producing a flow volume of combustion gases, the turbine engine having a suction side producing a negative pressure source, and a supercharger producing compressed air;

conducting the combustion gases at least into at least one impingement drying unit positioned to blow impingement drying air on one of a plurality of drying cylinders in a dryer section of the paper or board mill and using the combustion gases as impingement drying air;

connecting a plurality of suction rolls in the dryer section to a negative pressure network which supplies negative pressure from the suction side of the turbine engine.

14. The method of claim 13, further comprising a pressure network connected to the supercharger of the turbine engine, whereby compressed air produced by the turbine engine is conducted to said pressure network.

* * * * *